US006494447B2

(12) United States Patent
Myer, Sr.

(10) Patent No.: US 6,494,447 B2
(45) Date of Patent: Dec. 17, 2002

(54) STACKER WHEEL CONTROL APPARATUS AND METHOD UTILIZING START-STOP SYNCHRONIZATION

(75) Inventor: David E. Myer, Sr., Lexington, MA (US)

(73) Assignee: Giesecke & Devrient America, Inc., Dulles, VA (US)

( * ) Notice: Subject to any disclaimer, the term of this patent is extended or adjusted under 35 U.S.C. 154(b) by 0 days.

(21) Appl. No.: 09/877,110

(22) Filed: Jun. 11, 2001

(65) Prior Publication Data

US 2001/0050458 A1 Dec. 13, 2001

Related U.S. Application Data

(60) Provisional application No. 60/211,184, filed on Jun. 13, 2000.

(51) Int. Cl.[7] ..... B65H 43/00
(52) U.S. Cl. ..... 271/176; 271/187; 271/315
(58) Field of Search ..... 271/176, 187, 271/315, 265.01

(56) References Cited

U.S. PATENT DOCUMENTS

| | | | | |
|---|---|---|---|---|
| 3,531,108 A | * | 9/1970 | Rabinow et al. | 271/187 |
| 4,244,565 A | | 1/1981 | Geier | |
| 4,638,993 A | * | 1/1987 | Granzow | 271/315 |
| 4,881,731 A | * | 11/1989 | Simpson-Davis | 271/315 |
| 5,201,504 A | | 4/1993 | Fallos et al. | |
| 5,485,989 A | | 1/1996 | McCay et al. | |
| 5,641,156 A | | 6/1997 | Nukada et al. | |

FOREIGN PATENT DOCUMENTS

| | | |
|---|---|---|
| EP | 0308057 B1 | 12/1981 |
| EP | 0082195 B1 | 1/1986 |
| EP | 0308057 A1 | 3/1989 |
| EP | 0391550 A1 | 10/1990 |
| EP | 0647583 B1 | 11/1999 |
| FR | 2664581 | 1/1992 |
| GB | 2168687 | 6/1986 |
| JP | 611150959 | 7/1986 |
| WO | WO00/46137 | 8/2000 |

* cited by examiner

*Primary Examiner*—H. Grant Skaggs
(74) *Attorney, Agent, or Firm*—Bacon & Thomas, PLLC

(57) ABSTRACT

An inspection and/or processing apparatus for sheets such as banknotes includes a stacker wheel arrangement in which, rather than continuously rotating the stacker wheel and decelerating or accelerating the wheel to adjust the wheel speed in order to cause the grooves to align with the entrance chute at the same time that sheets arrive at the wheel, the stacker wheel is rotated only between sheet arrivals, and only for the purpose of indexing the stacker wheel to a new position at which a sheet can enter the stacker wheel without jamming. Indexing of the stacker wheel follows a predetermined profile, and the stacker wheel is held stationary at each predetermined aligned position until a respective individual sheet has entered the stacker wheel.

10 Claims, 3 Drawing Sheets

STACKER WHEEL CONTROL APPARATUS AND METHOD UTILIZING START-STOP SYNCHRONIZATION

This application claims the benefit of Provisional patent application Serial No. 60/211,184, filed Jun. 13, 2000.

BACKGROUND OF THE INVENTION

1. Field of the Invention

This invention generally relates to apparatus for inspecting or processing sheet materials such as bank notes, and in particular to the stacking or accumulation unit of a sheet material inspecting or processing apparatus. The stacking or accumulation unit includes at least one impeller or stacker wheel to which sheets are selectively fed following inspection or processing, a stepper motor for rotating the stacker wheel in order to accept the sheets and deposit them in a stack, and a stepper motor control circuit for synchronizing movement of the wheel with movement of the sheets by start-stop or intermittent operation of the stepper wheel. Movement of the stacker wheel is timed by the controller so that movement of the wheel occurs solely during the intervals between sheet arrivals, the wheel remaining stationary as individual sheets enter grooves in the wheel so as to prevent collisions between the arriving sheets and edges of the accumulation grooves in the wheel.

The invention also relates to a method of accumulating or stacking sheets following inspection or processing and selective diversion to a stacking or accumulation unit of the type which utilizes an impeller or stacker wheel to collect the sheets and deposit them in a stack. The method involves controlling the stacker wheel so that it moves only during the intervals between arrival of the sheets, and is stationary and perfectly positioned upon arrival of each sheet in order to prevent collisions between the arriving sheets and edges of the accumulation grooves in the wheel.

2. Description of Related Art

In general, the use of stacker wheels, also known as star wheels or accumulation impellers, for the purpose of accumulating and stacking sheet materials such as bank notes following inspection or processing, is well-known. As shown in FIGS. 1–3, the conventional stacker wheel 1 includes a plurality of spiral blades 4 which define accumulation grooves 5. As the wheel is rotated so that the grooves 5 successively are presented to a sheet arrival chute 6, the sheets are selectively diverted into the chute by a pivotal gate 7 based on the results of sheet inspection (for example, based on a determination of banknote denomination). The grooves absorb the forward momentum of the sheets so that they can be stacked without causing damage to the sheets. Following insertion of the sheets into grooves 5, the wheel is operated in a purge mode which deposits the sheets in an accumulation tray or bin 8.

Because of the high speed at which bank notes are processed, damage which can lead to misfeeding or jamming may occur if a sheet collides with one of the spiral blades 4 before properly entering the corresponding groove, as illustrated in FIG. 2. The possibility of collision results from even slight differences in arrival times of the sheets at the entrance to the accumulation device.

To reduce the possibility of collision, it has been proposed to increase the entrance angle so as to decrease the likelihood that a sheet will encounter the trailing side of a blade before entering the groove, but the reduction in collisions that can be achieved is limited. A more effective, but also more difficult solution to the problem of reducing collisions and jamming has been to synchronize rotation of the wheel with detected sheet arrivals by varying the rotation speed of the wheel, and in particular by accelerating or decelerating the wheel to adjust for deviations in arrival times of the sheets at the entrance to the accumulation device.

In order to synchronize rotation of the stacker wheel with arrival of sheets, the conventional apparatus includes, as shown in FIG. 3, at least one optical sensor 9 positioned upstream of the stacker wheel or accumulation unit and arranged to indicate the arrival of the sheet in the entrance chute 6. The optical sensor or sensors have outputs connected to a microcontroller 10. Microcontroller 10 supplies timing signals to a motor controller 11 to enable the motor controller to determine the arrival time of a sheet for the purpose of adjusting the speed that the stacker wheel is rotated by stepper motor 12, so that a sheet will begin entering one of the grooves 5 of the stacker wheel at the exact moment that the groove is aligned with the incoming sheet. In addition, microcontroller 10 synchronizes operation of the gate 7 and/or gate controller 7' so that notes are properly diverted into the accumulation device or sent downstream to another accumulation device or for further processing.

In the conventional method of controlling the apparatus of FIG. 3, as illustrated in FIG. 4, the motor controller 11, upon being informed by microcontroller 10 of an incoming sheet (step 1), calculates an arrival time for the sheet at the entrance to the groove based on the output of optical sensor 9 (step 2). Based on the detected position or phase of the stepper motor 12, the stepper motor controller 11 then calculates the deceleration or acceleration necessary to cause the groove to be in the proper position at the time of arrival of the sheet (step 3). The process is repeated for the next sheet.

In this method, all speed calculations and adjustments must be carried out between the time of arrival of a sheet at the optical sensor 9 and the time of arrival of the sheet at the stacker wheel 1. In the case of a U.S. or Canadian banknote inspection apparatus, in which individual sheets in the form of banknotes are fed at a rate of 10 sheets per second, the available time between arrival of the leading edge of one of the notes at the optical sensor and entry of the note into the stackerwheel is approximately 13.5 ms, while an additional 22 to 24 ms are required for the trailing edge of the note to enter the groove. Not only does this necessitate rapid processing capabilities, but the high torques required to accelerate or decelerate the motor in the limited time between completion of the speed calculation and arrival of the banknote places great physical demands on the conventional stepper motor used to rotate the stacker wheel.

An example of a prior continuous stacker wheel motor control arrangement which addresses the problem of high torques is disclosed in U.S. Pat. No. 5,641,156. In the system of this patent, in order to reduce the amount of acceleration or deceleration necessary to achieve precise phasing of the stacker wheel and the arriving notes, the stepper motor only accelerates or decelerates the stacker wheel if the pitch, i.e., spacing between notes is outside a predetermined range, and only accelerates or decelerates the note by an amount sufficient to bring the stacker wheel within a predetermined insertion range. In addition, an auxiliary drive is used to accelerate or decelerate the notes themselves in order to further reduce the amount by which the rotation speed of the stacker wheel needs to be varied.

Even with the modifications described in U.S. Pat. No. 5,641,156, however, sophisticated processing capabilities and a relatively high capacity motor are required in order to effect the continuous control necessary to ensure proper phasing, limiting the speed at which notes can be processed, and increasing the cost, weight, and power consumption of the device.

SUMMARY OF THE INVENTION

It is accordingly a first objective of the invention to provide a high speed sheet material processing and/or inspection apparatus of the type including a stacker wheel made up of a plurality of spiral blades defining grooves for collecting the sheets following inspection and/or processing, which minimizes the possiblity of jamming due to improperly timed arrival of the sheets.

It is a second objective of the invention to provide a high speed sheet material processing and/or inspection apparatus of the type including a stacker wheel made up of a plurality of spiral blades defining grooves for collecting the sheets following inspection and/or processing, in which successive grooves are perfectly positioned to accept respective successively arriving sheets without the need for continuous control and/or adjustment of the speed of the stacker wheel speed to compensate for variations in arrival times of the sheets.

It is a third objective of the invention to provide a high speed sheet material processing and/or inspection apparatus of the type including a stacker wheel made up of a plurality of spiral blades defining grooves for collecting the sheets following inspection and/or processing, in which successive grooves are perfectly positioned to accept respective successively arriving sheets, and yet which does not require any real-time calculations of sheet arrival time or continuous adjustment of stacker wheel position.

It is a fourth objective of the invention to provide a high speed sheet material processing and/or inspection apparatus of the type including a stacker wheel made up of a plurality of spiral blades defining grooves for collecting the sheets following inspection and/or processing, in which successive grooves are perfectly positioned to accept respective successively arriving sheets, and yet which utilizes a stepper motor arranged to follow a predetermined indexing profile that minimizes required torques in order to reduce required motor capacity while protecting the wheel and sheets captured by the wheel from stresses resulting from sudden repeated acceleration and deceleration.

It is a fifth objective of the invention to provide a high speed sheet material processing and/or inspection apparatus of the type including a stacker wheel made up of a plurality of spiral blades defining grooves for collecting the sheets following inspection and/or processing, which minimizes power consumption of the accumulation device.

It is a sixth objective of the invention to provide a method of controlling a stacker wheel in a high speed sheet inspection and/or processing apparatus, the stacker wheel including a plurality of blades defining spiral grooves, so that sheets arrive at the entrances to the grooves without colliding with edges of the grooves, and yet which does not require real time calculation of arrival times or continuous adjustment of stacker wheel speed to account for variations in arrival times of the sheets at the wheel.

These objectives are accomplished, in accordance with the principles of a preferred embodiment of the invention, by providing a stacker wheel arrangement in which, rather than continuously rotating the stacker wheel and decelerating or accelerating the wheel to adjust the wheel speed in order to cause the grooves to align with the entrance chute at the same time that sheets arrive at the wheel, the stacker wheel is indexed between aligned positions following a predetermined profile and held stationary at the aligned position until the sheet has arrived.

By moving or indexing the stacker wheel between predetermined stationary positions, the invention eliminates the need for real-time calculations of sheet arrival times since the indexing sequence need only be completed at some arbitrary time before the next sheet arrives, and not exactly upon arrival of the sheet at the wheel as in the continuous rotation apparatus and method. Thus, so long as the indexing time is less than the minimum time interval between sheet arrivals, the indexing sequence may be started at any time following insertion of the arrival of a sheet in a groove, and thus may be triggered by any signal associated with sheet arrival, including: (i) signals from an optical sensor situated upstream of the stacker wheel or at the entrance to the accumulation device, (ii) synchronization signals provided by or to a main accumulation unit controller for the purpose of operating the gate, or (iii) the occurrence of any other event associated with sheet arrival. For example, since the time of arrival of a sheet in a groove following detection of the trailing edge of the sheet at the optical sensor positioned before the entrance chute of the conventional stacker arrangement can be predetermined, the indexing procedure can be started a predetermined period after the trailing edge signal from the optical sensor, or the trailing edge of a "synch" signal based thereon.

While the manner in which the stacker wheel is indexed may be varied without departing from the scope of the invention, according to an especially preferred embodiment of the invention, the apparatus of the invention includes a PIC microcontroller arranged to generate an acceleration and deceleration profile which advances the stacker wheel a predetermined amount, such as 30 degrees, following entry of a sheet into the stacker wheel. A convenient starting point for the indexing procedure is the falling edge of a synchronization pulse generated by a main controller and sent to the PIC microcontroller, as well as to the gate controller, to indicate that a sheet is arriving and that the sheet is to be diverted to the stacker wheel. The leading edge of the synchronization pulse can occur at any time following the previous pulse, but the trailing edge of the synchronization pulse must occur before the trailing edge of the sheet enters the stacker wheel in order to leave enough time to start of a new synchronization pulse before arrival of another bank note.

By way of example, in the case of U.S. or Canadian banknotes fed at ten notes per second, rotation of the stacker wheel may be set to occur 9.5 ms after detection by the optical sensor of the trailing edge of the bank note, i.e., approximately 4 ms before the trailing edge of the banknote enters the stacker wheel, and thus the indexing process can safely be started by waiting 4 ms following an initial synchronization pulse.

In addition to using the trailing edge of the synchronization pulse to initiate an index cycle, the control apparatus and method of the preferred embodiment of the invention employs the synchronization pulse to determine when to begin a purge cycle, in which accumulated sheets or notes are removed from the stacker wheel. In particular, if there is no synchronization pulse for a predetermined extended period of time, such as 100 ms, a purge cycle of six consecutive indexes is initiated. If a synchronization pulse arrives during the purge cycle, then there must be enough time for the stacker wheel to move to an aligned position and complete at least the current purge index if not the entire purge cycle. Since an index cycle is approximately 30 seconds, so long as the leading edge of the synchronization pulse arrives at least about 35 ms before arrival at the stacker wheel of the banknote or other sheet, there will be sufficient time to complete the purge index.

According to yet another feature of the preferred embodiment of the invention, the stepper motor acceleration and deceleration profile output by the PIC microcontroller to the stepper motor controller may be designed to further minimize forces resulting from sudden acceleration and deceleration of the stacker wheel, by ensuring that the wheel is ramped up to full speed as gradually as possible, and then only gradually decelerated. Further shock protection may be provided by connecting the shaft of the stacker wheel to the motor via a helical spring or other damping device.

DETAILED DESCRIPTION OF THE PREFERRED EMBODIMENTS

Figure 5:
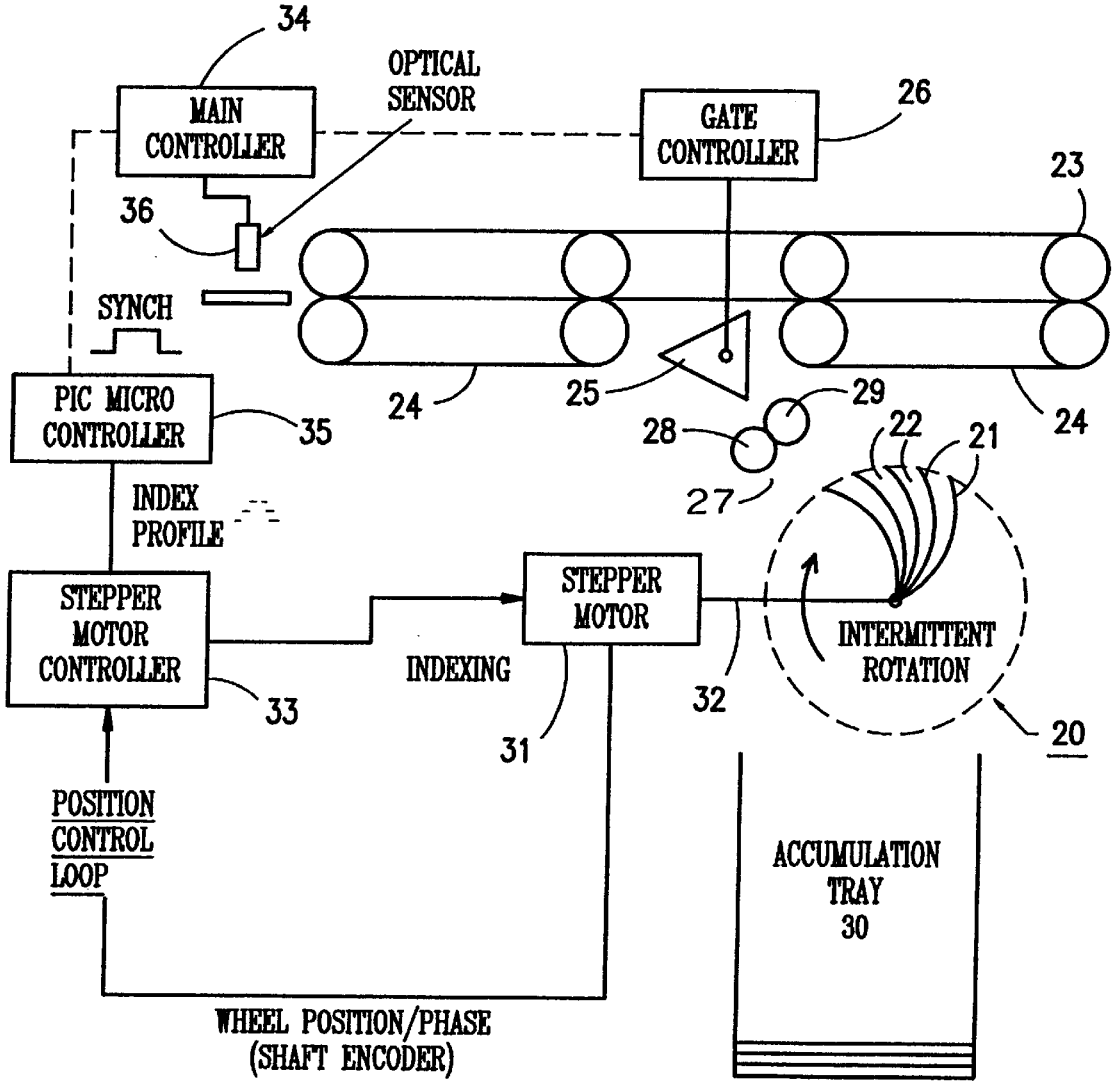
FIG. 5 is a schematic diagram of a sheet material accumulation unit having a synchronized stacker wheel with continuous speed adjustment according to a preferred embodiment of the invention.

As illustrated in FIG. 5, the accumulation unit of a high speed sheet material processing and/or inspection apparatus constructed in accordance with the principles of the preferred embodiment of the invention includes a stacker wheel 20 made up of a plurality of spiral blades 21 defining grooves 22 for collecting sheets such as U.S. or Canadian banknotes and separator cards following inspection and/or processing of the sheet. A conveyor made of drive belts 23 and 24 rapidly conveys the sheets through the accumulation unit to a gate 25 controlled by gate controller 26 for diverting or separating out selected sheets based on the results of tests, such as a determination of banknote denomination. The selected sheets are fed to an entrance chute 27, which may include rollers 28,29, and then to the stacker wheel 20, which transfers the sheets to an accumulation tray, bin, or other device 30 for removal or further processing.

The stacker wheel is driven by a stepper motor 31 via a shaft 32 under control of a stepper motor controller 33. Overall operation of at least the accumulation portion of the inspection apparatus is provided by a main controller 34, which is connected via an isolating optical interface to PIC microcontroller 35, which in turn is connected to stepper motor controller 33.

The PIC microcontroller has two functions:

1. To ensure that the grooves of the stacker wheel will align with an incoming note, the PIC microcontroller causes stepper motor controller 33 to index the stepper motor 31 to a position at which the groove is in the path of the incoming note, and is stationary when the note arrives, and 2. The PIC microcontroller also determines when to initiate a purge cycle, causing the stepper motor controller to rotate the wheel so as to purge sheets present in the grooves, causing them to fall into the accumulation tray 30.

As explained below, these two functions are initiated, in the preferred embodiment of the invention, in response to a synchronization signal SYNCH which is initiated by the main controller and may be related to control of the gate 26. Initiation of the synchronization signal depends on the results of upstream inspection and/or processing, i.e., on whether a sheet has completed processing and is on its way to the accumulation unit, and on whether the sheet should be diverted to the stacker wheel (those skilled in the art will appreciate that each apparatus or accumulation unit will normally have multiple stacker wheels arranged serially, although only one is shown herein). In addition, it is necessary that the synchronization signal be maintained long enough to ensure passage of a note that has actually reached the accumulation unit, and thus at least the trailing edge of the synchronization signal is dependent on the output of a sheet position sensor 36 that detects passage of a sheet towards the gate 25.

Figure 4:
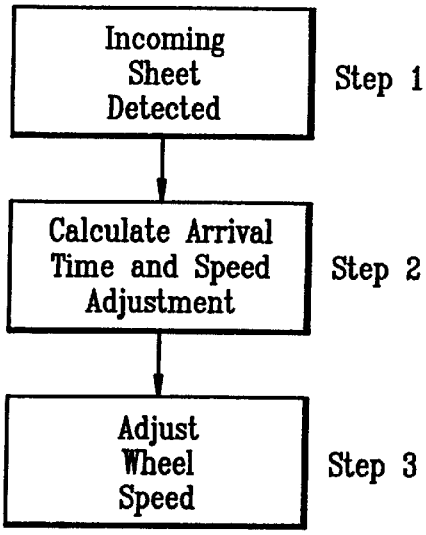
FIG. 4 (PRIOR ART)
FIG. 4 is a flow chart of the control procedure of a conventional stacker wheel arrangement.
Figure 1:
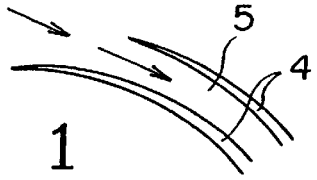
FIG. 1 (PRIOR ART)
FIGS. 1 and 2 are schematic illustrations of the manner in which a banknote enters a conventional stacker wheel.
Figure 2:
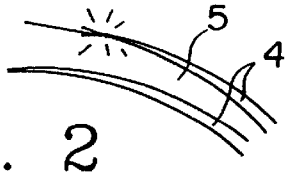
FIG. 2 (PRIOR ART)
Figure 3:
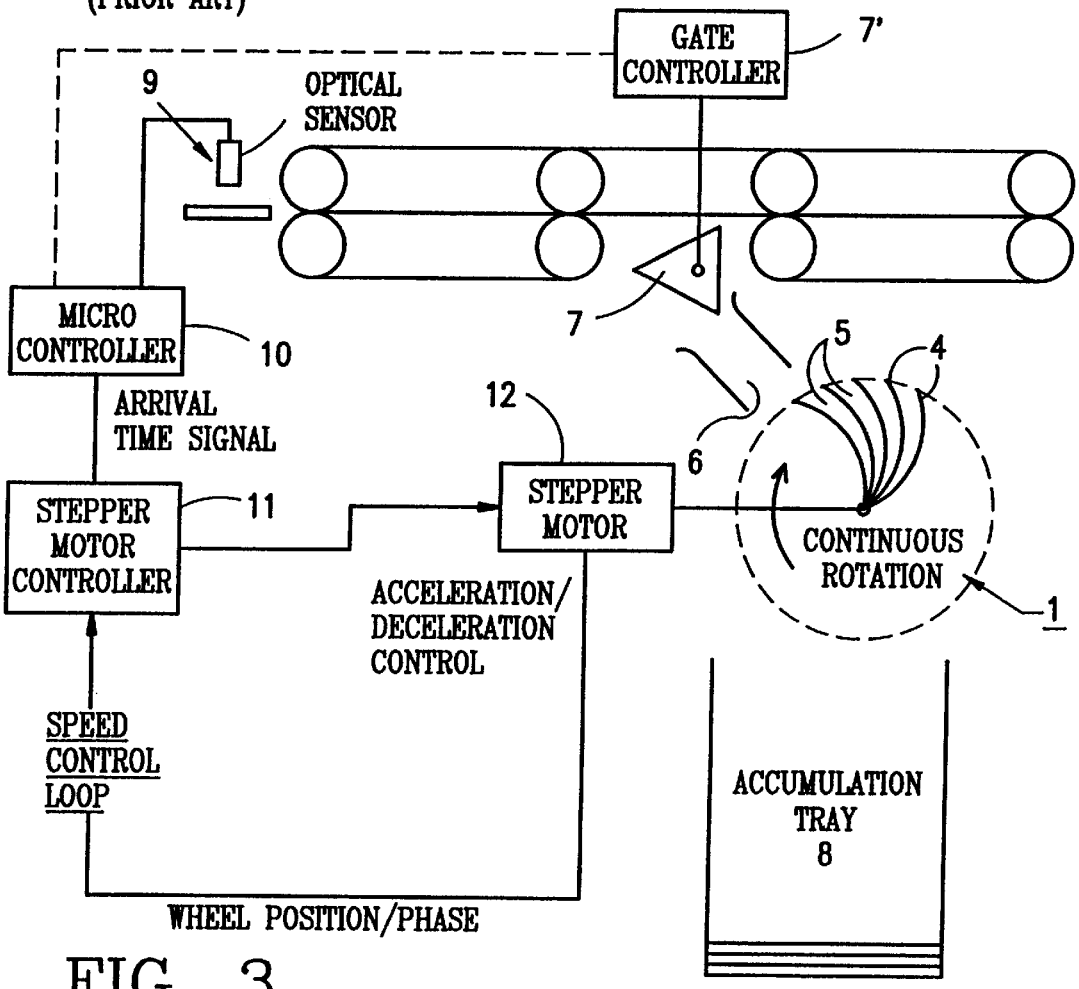
FIG. 3 (PRIOR ART)
FIG. 3 is a schematic diagram of a conventional sheet material accumulation unit having a synchronized stacker wheel with continuous speed adjustment.
Figure 6:
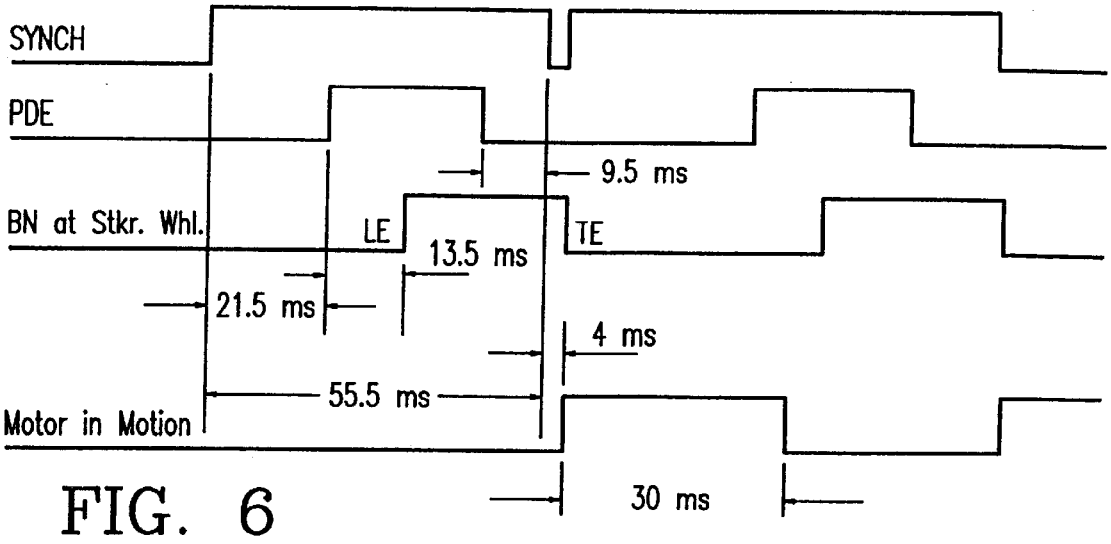
FIG. 6 is a timing diagram for the stacker wheel stepper motor controller of the preferred embodiment.
Figure 7:
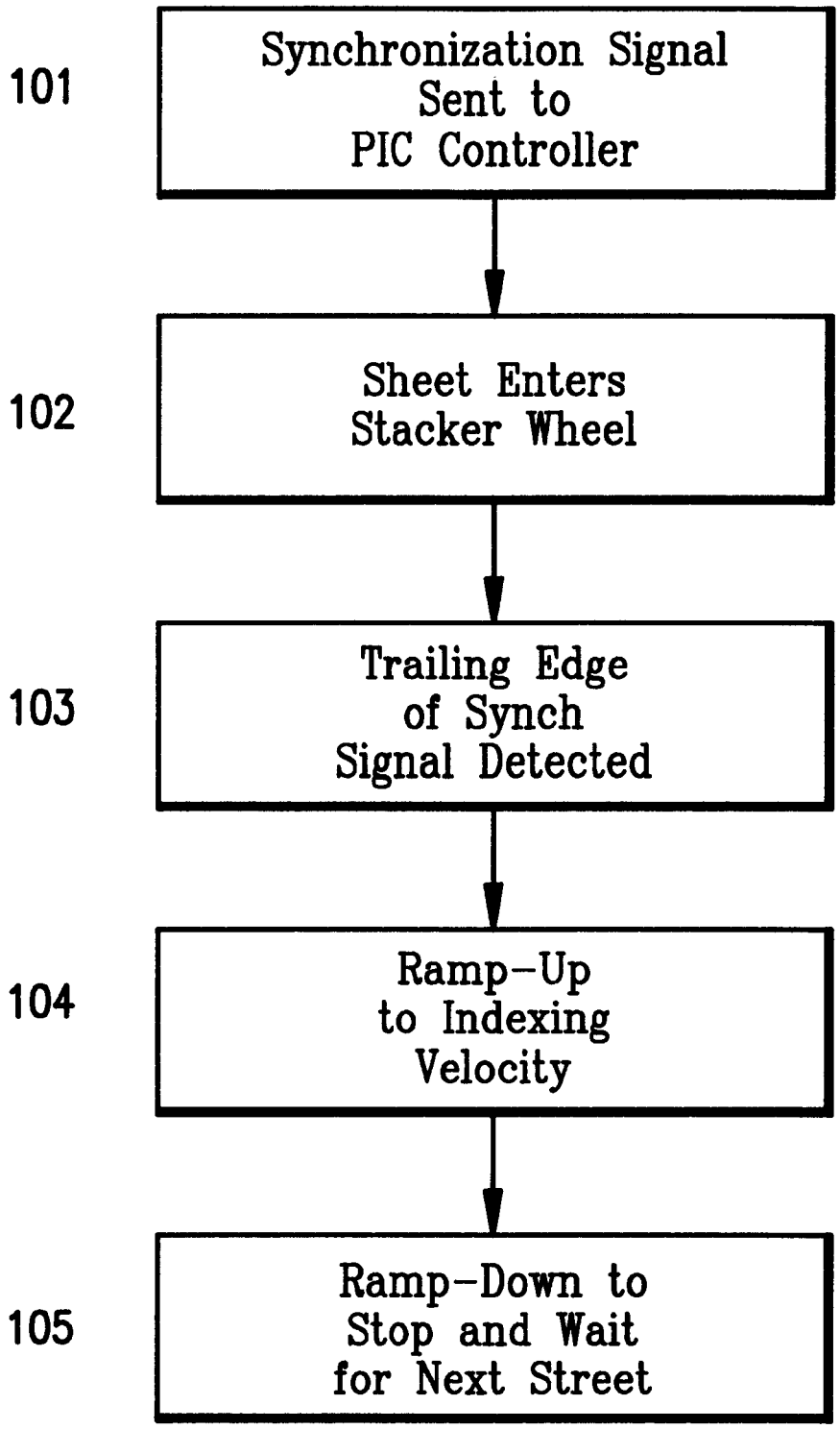
FIG. 7 is a flowchart of a motor control program for the sheet material accumulation unit illustrated in FIG. 5.

As illustrated in FIGS. 6 and 7, which specifically illustrate the example of a U.S. or Canadian banknote inspection apparatus, whenever a sheet is intended to be sent to the stacker wheel, either following start-up or a previous purge cycle (during which the stacker wheel emptied and one of the grooves positioned to accept a new sheet), a synchronization signal SYNCH is sent to the PIC controller (step 101), and the leading edge of a sheet passes the optical sensor 36 (whose output is indicated by the letters PDE in FIG. 6), followed 4 ms later by arrival of the sheet at the stacker wheel (step 102). The trailing edge of the sheet then passes the sensor 36, followed 4 ms later by entry of the trailing edge of the sheet into the stacker wheel and turn-off of the synchronization pulse SYNCH (step 103).

Upon detecting the trailing edge of the synchronization pulse, PIC microcontroller 35 initiates a new index cycle, which begins with a 6 ms stationary period followed over a total period in motion of at most 30 ms, a ramp up in shaft angular velocity to peak (step 104) and a ramp down to stop (step 105). The stacker wheel then remains stationary, in position to receive the next incoming sheet, until the next sheet has arrived and another synchronization pulse trailing edge is detected or a purge cycle is initiated.

Sheets are removed from the stacker wheel, i.e., a purge cycle is initiated, whenever a synch pulse, indicating the arrival of a sheet, is not received for a predetermined period of time. In the illustrated example, the predetermined period of time is selected to be 100 ms, and the purge cycle consists of six consecutive indexes, although these numbers may be varied as desired. A new synchronization pulse could be received at any time during a purge cycle, in which case the current purge index is completed. Since completion of an index occurs within 30 ms and the banknote takes 35 ms to arrive following the leading edge of the synchronization pulse, the index will have been safely completed by the time the banknote arrives, after which normal indexing can again occur on the trailing edge of the synchronization pulse.

Although not shown, those skilled in the art will appreciate that stepper motor control may be facilitated by the inclusion on the stepper motor shaft of a shaft encoder or encoder wheel marked, notched, or otherwise arranged to provide an indication of shaft position, as well as a counter for determining how far the shaft has been rotated during the indexing procedure. Details of the stepper motor and of circuitry that enables a stepper motor to step to a predetermined position are well-known to those skilled in the art and form no part of the present invention.

In addition, those skilled in the art will appreciate that the architecture of the accumulation device illustrated in FIG. 5 may be varied without departing from the scope of the invention. For example, the main controller 34, PIC microcontroller 35, and stepper motor controller 33 may be implemented as a single computing device, discrete circuit elements, multiple controllers, and so forth.

Finally, it will further be appreciated by the skilled artisan that the timing at which the index cycle and/or the purge cycle is started may be varied in numerous ways, and that the invention is not to be limited to a particular starting signal, and in particular is not to be limited to starting based on the synchronization pulse. For example, starting of the indexing cycle could be triggered by the trailing edge of a pulse output by optical sensor 36 rather than by the trailing edge of the above-described synchronization pulse, or upon direct detection by suitably placed sensor that the banknote has entered a groove of the stacker wheel.

As a result of the possibility of variations and modifications of the apparatus and method described herein, and despite having described the preferred embodiment of the invention in sufficient detail to enable those skilled in the art to make and use the invention, it will be appreciated that numerous variations and modifications of the illustrated embodiment may be made without departing from the spirit of the invention, and it is intended that the invention not be limited by the above description or accompanying drawings, but that it be defined solely in accordance with the appended claims.

I claim:

1. A stacker wheel start-stop synchronization arrangement for a sheet inspection or processing apparatus, comprising:

a stacker wheel connected to a shaft and including a plurality of spiral blades defining grooves into which sheets are intermittently diverted;

a stepper motor connected to said shaft for accelerating, rotating and decelerating the stacker wheel; and a controller connected to said stepper motor and arranged to:

a. hold said stacker wheel stationary in a first, predetermined position at which a first sheet will enter a first groove without jamming, until the first sheet has entered said first groove, b. before a second sheet arrives, index the stacker wheel to a second, predetermined position at which a second sheet will enter a second groove without jamming, and c. hold the stacker wheel stationary at the second position at least until the second sheet enters the second groove, thereby providing stop/synchronization of the stacker wheel with arriving sheets.

2. A stacker wheel start-stop synchronization arrangement as claimed in claim 1, wherein said controller is arranged to receive a synchronization signal from a main controller, and to begin to index the stacker wheel upon detecting a trailing edge of respective sheet material.

3. A stacker wheel start-stop synchronization arrangement as claimed in claim 2, wherein said controller initiates a purge cycle if said synchronization signal has not been received within a predetermined time interval.

4. A stacker wheel start-stop synchronization arrangement as claimed in claim 1, wherein said controller is arranged to index said stacker wheel by gradually accelerating the stacker wheel to a maximum speed and gradually decelerate the stacker wheel to a stationary position.

5. A stacker wheel start-stop synchronization arrangement as claimed in claim 1, wherein said sheet inspection apparatus is a banknote inspection apparatus.

6. A start-stop synchronization method for a stacker wheel in a sheet inspection or processing apparatus, the stacker wheel connected to a shaft and including a plurality of spiral blades defining grooves into which sheets are intermittently diverted, and the stacker wheel being rotated by a stepper motor on said shaft, comprising the steps of:

a. holding said stacker wheel stationary in a first, predetermined position at which a first sheet will enter a first groove without jamming, until the first sheet has entered said first groove, b. before a second sheet arrives, indexing the stacker wheel to a second, predetermined position at which a second sheet will enter a second groove without jamming, and c. holding the stacker wheel stationary at the second position until the second sheet enters the second groove, thereby providing stop/synchronization of the stacker wheel with arriving sheets.

7. A stacker wheel start-stop synchronization method as claimed in claim 6, wherein step b. comprises the steps of receiving a synchronization signal from a main controller, and beginning to index the stacker wheel upon detecting a trailing edge of a respective sheet.

8. A stacker wheel start-stop synchronization method as claimed in claim 7, further comprising the step of initiating a purge cycle if said synchronization signal has not been received within a predetermined time interval.

9. A stacker wheel start-stop synchronization method as claimed in claim 6, wherein said indexing step is carried out by gradually accelerating the stacker wheel to a maximum speed and gradually decelerate the stacker wheel to a stationary position.

10. A stacker wheel start-stop synchronization method as claimed in claim 6, wherein said sheets are banknotes.

* * * * *